US009449538B2

(12) United States Patent
Davis et al.

(10) Patent No.: US 9,449,538 B2
(45) Date of Patent: Sep. 20, 2016

(54) DISPLAY SYSTEM, DISPLAY PROCESS AND ENGAGEMENT FEATURE

(75) Inventors: Adam Davis, Leola, PA (US); Frederic Frank Opsomer, Kortemark (BE)

(73) Assignee: Tait Towers Manufacturing, LLC, Lititz, PA (US)

( * ) Notice: Subject to any disclaimer, the term of this patent is extended or adjusted under 35 U.S.C. 154(b) by 0 days.

(21) Appl. No.: 13/543,000

(22) Filed: Jul. 6, 2012

(65) Prior Publication Data

US 2013/0232835 A1 Sep. 12, 2013

(51) Int. Cl.

| | |
|---|---|
| ***G09F 7/00*** | (2006.01) |
| ***G09F 9/33*** | (2006.01) |
| ***G09F 15/00*** | (2006.01) |
| ***G09F 19/22*** | (2006.01) |
| *G09F 9/302* | (2006.01) |

(52) U.S. Cl.

CPC ..... *G09F 9/33* (2013.01); *G09F 15/0068* (2013.01); *G09F 19/22* (2013.01); *G09F 19/226* (2013.01); *G09F 9/3026* (2013.01)

(58) Field of Classification Search

CPC ..... H04N 6/55; G09G 2380/02
USPC ..... 40/617, 605
See application file for complete search history.

(56) References Cited

U.S. PATENT DOCUMENTS

| | | | | |
|---|---|---|---|---|
| 4,512,097 | A | 4/1985 | Zeigler | |
| 5,900,850 | A * | 5/1999 | Bailey | G09F 9/33 340/815.83 |
| 6,327,803 | B1 * | 12/2001 | Ruderman | 40/601 |
| 6,704,989 | B1 * | 3/2004 | Lutz | G09F 9/30 29/426.1 |
| 7,086,190 | B2 * | 8/2006 | Voluckas | 40/617 |
| 7,107,712 | B2 * | 9/2006 | Mueller | 40/546 |
| 7,966,756 | B1 * | 6/2011 | Stafford | G09F 13/22 40/544 |
| 2009/0290076 | A1 | 11/2009 | Tait et al. | |

FOREIGN PATENT DOCUMENTS

| | | | |
|---|---|---|---|
| EP | 1293955 | A2 | 3/2003 |
| EP | 2037438 | A1 | 3/2009 |
| WO | 2005036507 | A2 | 4/2005 |
| WO | 2007035992 | A1 | 4/2007 |

* cited by examiner

*Primary Examiner* — Cassandra Davis
(74) *Attorney, Agent, or Firm* — McNees Wallace & Nurick LLC

(57) ABSTRACT

A display system, a display process, and an engagement feature are disclosed. The display system includes a first display arrangement, a second display arrangement, and a flexible support extending from the first display arrangement to the second display arrangement. The first display arrangement engages the second display arrangement by movement of the flexible support.

13 Claims, 16 Drawing Sheets

DISPLAY SYSTEM, DISPLAY PROCESS AND ENGAGEMENT FEATURE

FIELD OF THE INVENTION

The present invention relates to displays and processes of erecting and disassembling displays. More specifically, the present invention relates to displays, processes, and engagement features using flexible supports.

BACKGROUND OF THE INVENTION

In the performance industry, video displays are used in conjunction with multi-media systems utilized in productions. Video displays can be limited in size due to the complexity of arranging the video displays and/or due to the issues associated with weight distribution.

When being used as part of a touring production, video displays are often consolidated and stored for transportation. Known systems are rigid and require significant time for arranging (for example, consolidating, disassembling, and assembling). The video displays may be assembled by individuals of varying level of skill. The arranging of these video displays may require complex diagrams, may require several tools, and may be difficult to repair or replace.

In addition to limiting methods of arranging the video displays, rigidity may prevent aesthetic benefits associated with flexibility. Known systems do not adequately provide three-dimensional displays of two-dimensional videos and do not adequately permit rotation of displays. Also, known systems do not adequately permit video displays to be flexibly manipulated and/or rotated.

When video displays are partially assembled or fully assembled, inconsistent and/or undesired weight distribution can limit the size of the video displays. If the weight distribution puts stress on connectors in the video display, then the connectors can fail. Failure of connectors may result in failure of the video display.

Therefore, there is an unmet need to provide a display system, a display process and engagement feature capable of consistent simple and/or strong assembly.

SUMMARY OF THE INVENTION

In an exemplary embodiment, a display system includes a first display arrangement, a second display arrangement, and a flexible support extending from the first display arrangement to the second display arrangement. The first display arrangement engages the second display arrangement by movement of the flexible support.

In another exemplary embodiment, a display process includes providing a display system having a first display arrangement, a second display arrangement, and a flexible support extending from the first display arrangement to the second display arrangement. The process further includes moving the flexible support, thereby engaging the first display arrangement with the second display arrangement.

In another exemplary embodiment, an engagement feature is configured to selectively connect a first display arrangement to a second display arrangement. The engagement feature includes a positioning feature capable of adjusting the relative position of the first display arrangement in comparison to the second display arrangement, thereby permitting a flexible support extending from the first display arrangement to the second display arrangement to engage the first display arrangement to the second display arrangement.

BRIEF DESCRIPTION OF THE DRAWINGS

Wherever possible, the same reference numbers will be used throughout the drawings to represent the same parts.

DETAILED DESCRIPTION OF THE INVENTION

Provided is a display system, a display process, and an engagement feature capable of consistent simple and/or strong assembly. Embodiments of the present disclosure decrease the number and type of tools required for assembly, permit the ability to have a flexible display component capable of being flexibly manipulated while retaining the desired display characteristics, permit selectable distribution of weight allowing the flexible display to provide an assembled set of display components that is large, permit flexible displays to extend tens or hundreds of feet in multiple dimensions, permit the reduction or elimination of the need for vertical supports within display devices thereby significantly reducing the weight of the overall system, permit a faster and/or more accurate assembly, permit assembly by personnel having little or no technical skill, and combinations thereof.

Figure 1:
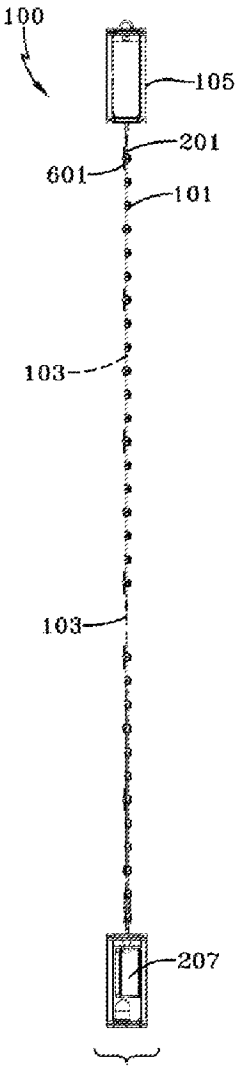
FIG. 1 illustrates a side view of an exemplary embodiment of a video display system.
Figure 2:
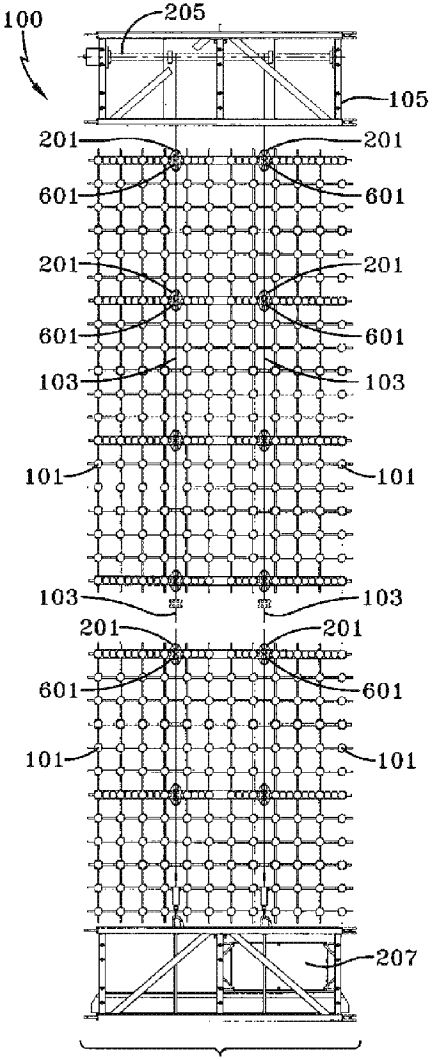
FIG. 2 illustrates a front view of another exemplary embodiment of a video display system.

Referring to FIGS. 1 and 2, a display system 100 (shown as a video display system) includes a flexible support 103, a display device 101 detachably engaged to flexible support 103, and a coupling device (shown as a clipping member 601) engaged to flexible support 103 and display device 101 at a first location 201 on display device 101. The display system 100 is any suitable display. Suitable displays include videos, electronic media, lights, panels of lights, mirrors, paintings, printings, faux surfaces, temporary wall surfaces, temporary borders, and combinations thereof. The arrangement of system 100 can provide selective distribution of weight of display device 101 at first location 201.

Flexible support 103 can be a cable or cables configured to enable system 100 to be suspended from an architectural member 105. While flexible support 103 is being described as a cable or cables, the disclosure is not so limited. Flexible support 103 may be any elongate, flexible structure capable of bearing significant weight. For example, suitable flexible supports 103 may include, but are not limited to, flexible tapes, ropes, wires, other suitable flexible structures, or combinations thereof. Architectural member 105 may be a steel beam, an existing stage system, another cable, a bridge, a wall, a telephone post, a trestle, a truss, other suitable type of architectural system, or combinations thereof. In one embodiment, flexible support 103 can be two weight-bearing cables suspended from architectural member 105. Weight-bearing cables can be arranged such that display device 101, for example panels or other suitable light emitting devices, may be suspended from architectural member 105. Flexible support 103 may be attached to architectural member 105 in any suitable manner. In an exemplary embodiment, flexible support 103 may be high strength cables capable of supporting the weight of panels and any additional equipment or components below architectural member 105. In one embodiment, although not so limited, the cable is aircraft grade cable having an outer diameter of about ⅛ inch.

In another embodiment, flexible support 103 may include power and/or signal functionality. For example, flexible support 103 may be one or more communication and/or power providing cables, such as fiber-optic or copper-based wires or cables, or Ethernet cables. The use of flexible support 103 can reduce the amount of weight in the system by removing bulky structural support systems like intermediate trusses. In addition, the use of flexible support 103 can permit flexibility for additional display options, such as rotating, bending, rounding, or flapping. For example, a rounded visual display may be formed using flexible support 103. In addition, the ability for flexible support 103 to curve can permit a display of a fixed image in motion, such as a flag appearing to wave in the wind. In another embodiment, system 100 can be moved by the motor or other device thereby creating a three-dimensional effect of the displayed image.

Referring to FIG. 2, flexible support 103 may be wires, such as power cords, run along-side cables and connected to a controller 207. In one embodiment, the wires and the cables may be integrated. In another embodiment, the wires may be integrated by being circumferentially bounded by cables thereby forming flexible support 103. In another embodiment, wires may act as flexible support 103.

System 100 of the present disclosure can be portable, allowing easy assembly and disassembly. Flexible support 103 can be detachably engaged to display device 101 by the coupling device, such as clipping member 601. Assembly of system 100 can be easily done by manually or automatically mounting or detachably engaging the display device onto the flexible supports. In one embodiment, display device 101 may be attached to flexible support 103 at first location 201, flexible support 103 may be advanced thereby permitting a second display device 101 to be attached at another first location 201. The advancing of flexible support 103 may be incremental or constant. The sequential attaching and/or detaching of first display device 101, second display device 101, and any additional display devices 101 may permit use of fewer tools for stabilizing system 100 while partially arranged. The sequential attaching and/or detaching may permit fewer individuals to arrange system 100, may provide additional protection during arrangement of system 100, and may permit transportation of system 100. The advancing and the attaching can be repeated to arrange a desired number of display devices 101. While partially assembled and while fully assembled, system 100 can provide selective distribution of weight from display device(s) 101 to flexible support 103. The term "selective distribution" as utilized herein means a consolidation of the weight of the individual display devices 101 at one or a few first locations 201. In one embodiment, the selective distribution consolidates the weight of each display device 101 onto locations along flexible support 103 such that the flexible supports 103 bear the weight of all of the display devices 101. The selective distribution of weight permits the display devices to have less support structure within themselves and permits large numbers of display devices 101 to be assembled vertically.

In one embodiment, the advancing of the flexible supports 103 may be performed by a winding mechanism 205. System 100 can be raised by use of a motor and winding mechanism 205 (for example, a chain motor). In another embodiment, architectural member 105 may additionally and/or alternatively be raised. The ability to raise and lower system 100, including raising and lowering of portions of system 100 may permit incremental arrangement of display devices 101, for example, incremental assembly, disassembly, and/or consolidation of display devices 101. That is, display devices 101 may be attached to flexible support 103 at ground level and then lifted to the operational height. In one embodiment, display device 101 may be lifted from a display storage unit 901, such as a cart (see FIG. 10) and manually or automatically mounted on flexible support 103. Use of display storage unit 901 permits consolidated storage and/or transportation, as well as a quick assembly of system 100 for more consolidated storage or transportation. In another embodiment, each of display devices 101 may be separately stored and transported for engagement of flexible support 103 at a new location.

Controller 207 may be located in architectural member 105, for example, above or below display device 101. In another embodiment, the controller 207 may be remote to the system 100 and/or integrated into the controls of a theatrical performance. Controller 207 may be electrically connected to display device 101 thereby permitting power and/or signals to travel to display device 101. In one embodiment, controller 207 may be housed in any suitable architectural structure inside or outside system 100. Optional support members 203 may provide a desired stiffness to certain portions of panel 101 and may provide additional support horizontally and/or vertically for display device 101. The selective distribution of the weight of the display devices 101 reduces or eliminates the need for support members 203 in a vertical direction (for example, the direction parallel to the flexible supports).

Figure 3:
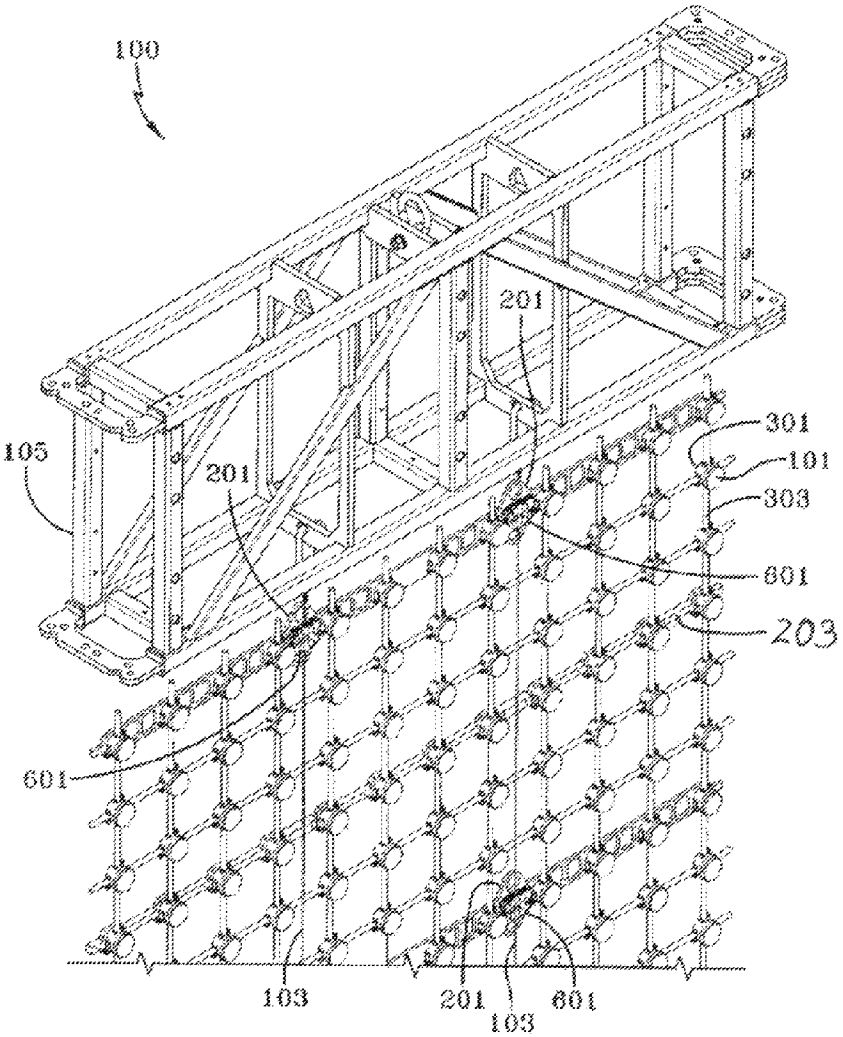
FIG. 3 illustrates a partial perspective view of another exemplary embodiment of a video display system.
Figure 4:
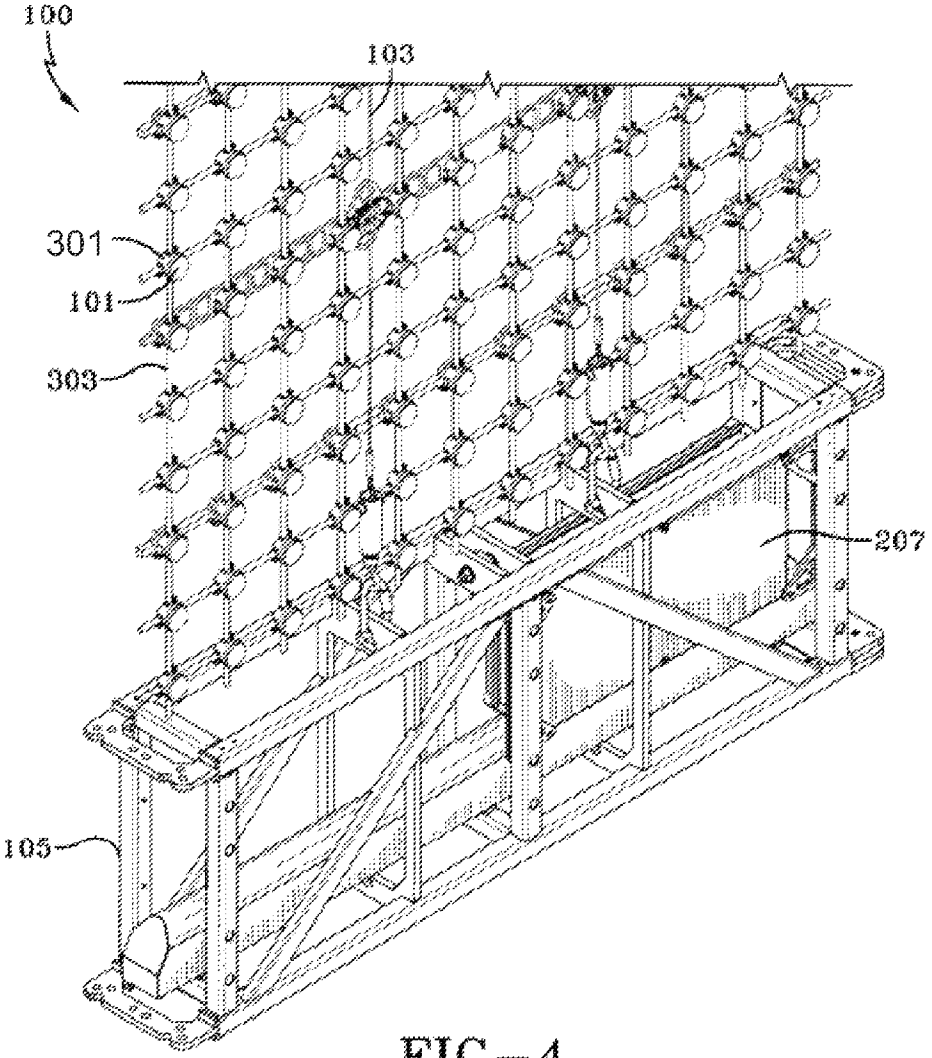
FIG. 4 illustrates a partial perspective view of another exemplary embodiment of a video display system.

Referring to FIGS. 3 and 4, display device 101 can be one or more light emitting devices. For example, the light emitting devices may be light emitting diodes (LEDs) housed within a housing 301 that may be transparent, translucent, semi-transparent, semi-translucent, or a combination thereof. In one embodiment, the LEDs may be configured to emit colored light based upon a signal from controller 207. In another embodiment, the light emitting devices may emit a single color of light. In another embodiment, the light emitting devices may emit multiple colors of light simultaneously or at different times. In yet another embodiment, multiple LEDs may be housed within the same housing 301. In yet another embodiment, with the multiple LEDs housed in the same housing 301, LEDs configured to emit multiple colors such that the different colors are mixed within housing 301 thereby permitting additional control of the image or series of images displayed.

In one embodiment, the light emitting devices may be connected to each other in a grid pattern of wires 303. Wires 303 may be connected to the light emitting devices by any suitable technique or connector. Wires 303 can provide support for adjacent light emitting devices within display device 101. Wires 303 can be arranged in conjunction with flexible support 103 to provide selective distribution of weight of display device 101. In another embodiment, the light emitting devices may be connected with wires 303 that are fiber-optic cables permitting the light to be emitted from various sources. In yet another embodiment, wires 303 may be translucent, transparent, semi-transparent, semi-translucent, semi-opaque, opaque, or combinations thereof. In another embodiment, system 100 may utilize wireless control and/or wireless power to provide control and power from a remote location, providing reduced weight and greater portability.

Figures 5A, 5B:
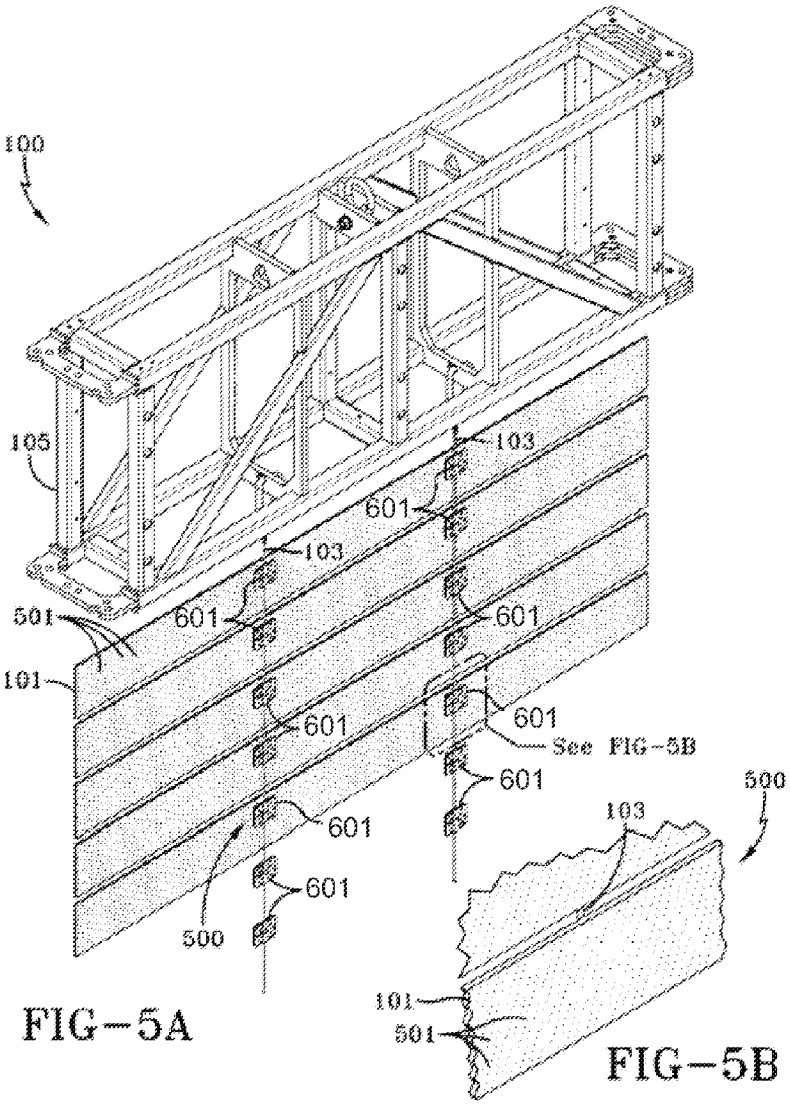
FIG. 5A illustrates a partial perspective view of another exemplary embodiment of a video display system.
FIG. 5B illustrates a reverse view of a portion of FIG. 5A.
Figure 11:
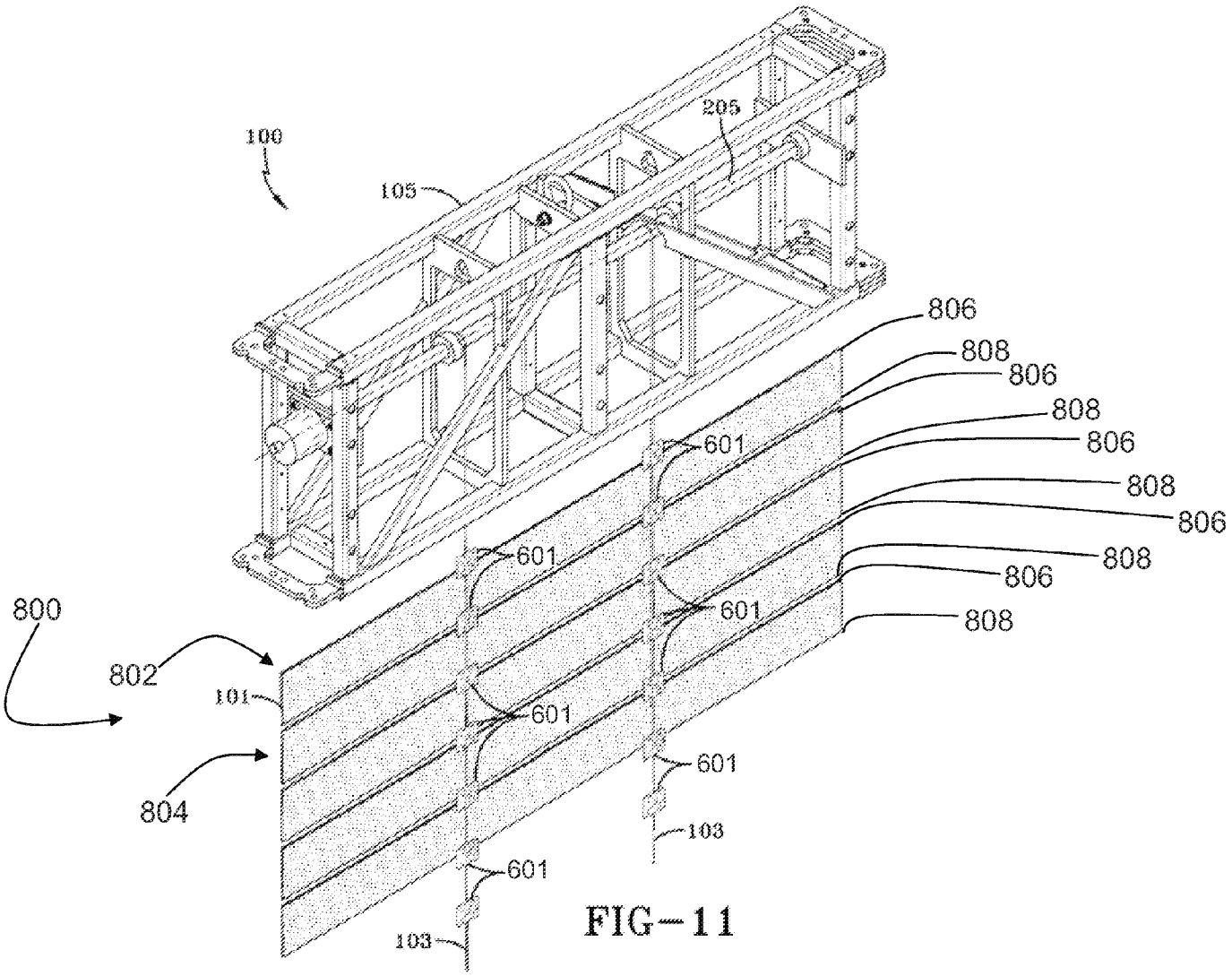
FIG. 11 illustrates a perspective view of another exemplary embodiment of a video display system.

Referring to FIG. 5A, display device 101 can be a panel (for example, a low or high resolution LED panel) configured to display lighting and/or video presentations. The panel can be attached onto portions or the entire system 100. In one embodiment, a large number of closely spaced LEDs 501 may be included thereby creating the effect that LEDs 501 are of high resolution. In another embodiment, the panels may additionally or alternatively include Organic Light Emitting Diodes ("OLEDs") or other light sources capable of displaying images, video, or other visual displays. The panels may be attached to various portions of system 101. The panels can be semi-translucent, semi-transparent, transparent, translucent, semi-opaque, opaque, or combinations. In addition, LEDs 501 may be connected by electrical and/or control wires or other connectors with or without additional structural support. In one embodiment, panels may permit high resolution including a large number of colored, closely spaced pixels permitting a clear, high resolution image, series of images, and/or video. Referring to FIG. 5B, which shows a reverse view of region 500 in FIG. 5A, the flexible supports 103 and clipping member 601 (See FIG. 5A) provide selective distribution of the weight of the individual panels. The configuration according to the disclosure permits large numbers of panels to be assembled into system 100 with little additional support structure. In addition, the use of the flexible support 103 and clipping member 601 allows large numbers of panels to be assembled into system 100 quickly and accurately. Referring to FIG. 11, display devices 101 can be positioned with clipping members 601 adjacent to an additional display device 101. In this embodiment, additional rigidity can be provided.

In one embodiment, display device 101 may be powered by individual batteries housed with LEDs or other light sources. In another embodiment, LED can have a battery power source and another LED can use the battery as a power source by having wires carrying power from other LEDs.

Another embodiment includes OLEDs as LEDs. OLEDs may reduce power requirements and permit longer operation on the same charge. OLEDs may permit display device 101 to run on the same charge for a long period of time, for example, by providing power to the OLEDs and then disconnecting the power source from the OLEDs, and then displaying the system.

Figure 6:
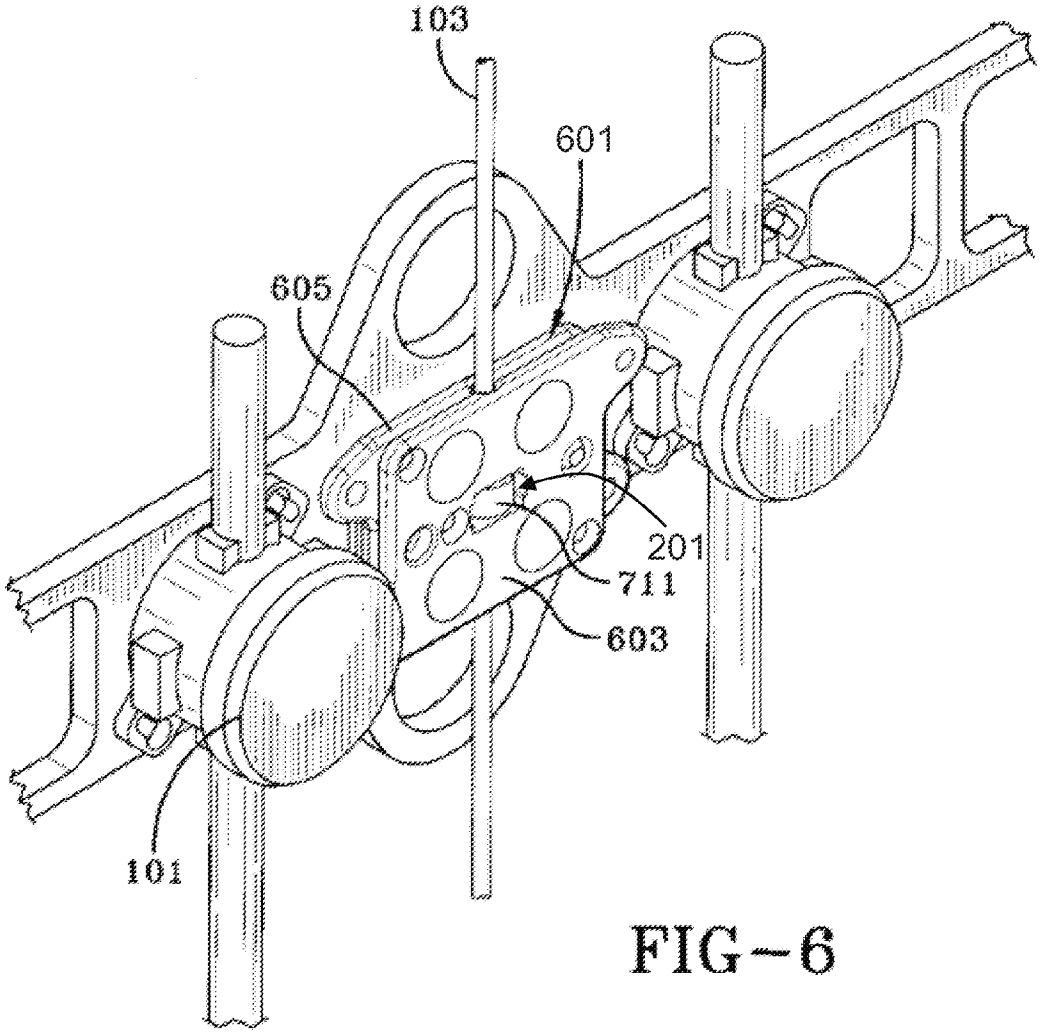
FIG. 6 illustrates an enlarged partial perspective view of another exemplary embodiment of a video display system.
Figure 7:
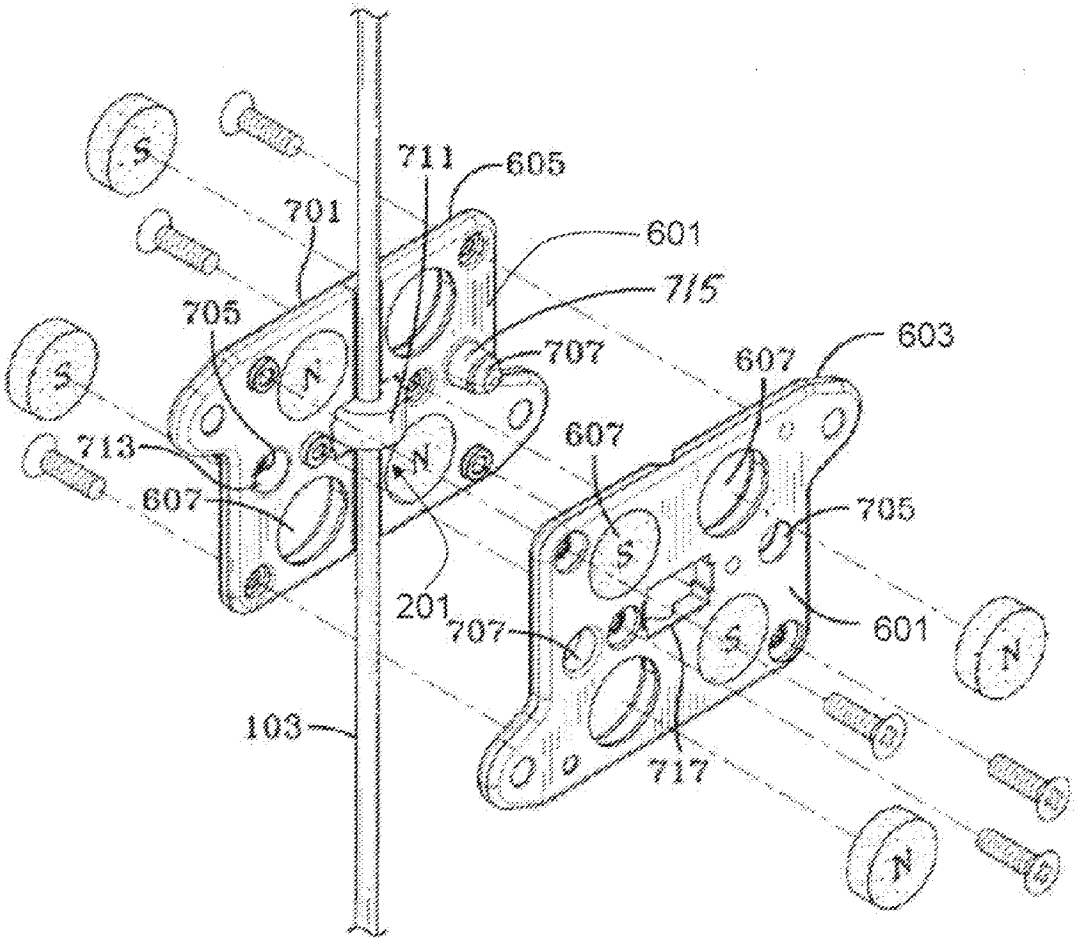
FIG. 7 illustrates an enlarged exploded partial perspective view of another exemplary embodiment of clipping member.
Figure 8:
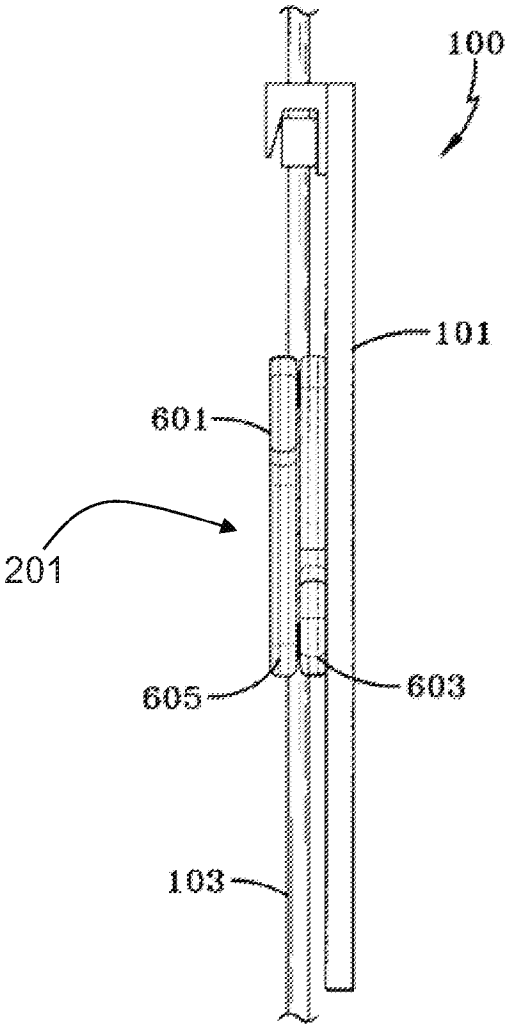
FIG. 8 illustrates a partial perspective view of another exemplary embodiment of a video display system.

Referring to FIGS. 6 through 8, the coupling device can be clipping member 601. Clipping mechanism 601 can be engaged to flexible support 103 and display device 101 at first location 201 on display device 101. Clipping mechanism 601 can be arranged to connect flexible support 103 to display device 101 and disposed for allowing a lattice of display devices 101 to be clipped onto flexible support 103. Clipping mechanism 601 includes a first mating portion 603 and a second mating portion 605 that engage each other and provide connecting support. In one embodiment, clipping member 601 may be configured to permit engagement and support of weight of display device 101. Clipping mechanism 601 may include latches, clips, hooks, or other interlocking features that provide additional support. In addition, clipping member 601 may include a quick connect or otherwise manually operable connections that are easily engaged and disengaged. First mating portion 603 attaches to flexible support 103 at first location 201. The attachment may include any suitable attachment method for attaching rotatable bodies to wires and/or cables. In one embodiment, the first mating portion 603 is rotatably mounted about a ring clamp 711 or other clamping device capable of selectively mounting to flexible support 103. Ring clamp 711 immovably engages the flexible support 103 by set screws or a similar device. First mating portion 603 engages ring clamp 711 and is rotatable around flexible supports 103. When the second mating portion engages the first mating portion 603, the weight of the display device 101 is supported by the flexible support 103 at a first location at the ring clamp 711.

Referring to FIGS. 7 and 8, the coupling device can be one or more clipping members 601. Clipping member 601 can be engaged to flexible support 103 and display device 101 at first location 201 on display device 101. In one embodiment, clipping member 601 may include interlocking features to provide additional support. Clipping member 601 may include an interlocking feature 707, an interlocking receiving opening 705, and other features. In another embodiment, clipping member 601 may be a magnetic coupling member 701. Clipping member 601 may include magnets 607 that attract and engage corresponding magnets on display device 101, on flexible support 103, and/or on another clipping member 601. Clipping member 601 may be machined, cast or otherwise formed of plastic or other non-magnetic material. Clipping member 601 may be made of other materials that permit magnetic forces to magnetically attract and/or attach to other surfaces or structures. In another embodiment, first mating portion 603 may be rotated around flexible support 103. In one embodiment, clipping member 601 can be engaged to flexible support 103 and display device 101 at a second location on display device 101, on a second display device 101, and/or on a second flexible support 103.

In one embodiment, interlocking feature 707 may be received by the interlocking receiving opening 705. In other embodiments, clipping member 601 may include other configurations of interlocking features 707 and/or interlocking receiving openings 705. Alternatively, the clipping member 601 may have no interlocking feature 707 and/or no interlocking receiving opening 705. Interlocking receiving opening 705 may be a recess or opening with one or more sides 713 forming a sloping geometry configured to correspond with the geometry of one or more side walls 715 of interlocking feature 707. Clipping member 601 can be configured to interlock or otherwise engage with substantially identical corresponding clipping member 601 or dissimilar clipping members 601 having corresponding interlocking features 707 and/or interlocking receiving openings 705. Magnetic clipping members 601 may be configured to correspond with other magnetic clipping members 601 and/or features of non-magnetic clipping members 601.

Clipping members 601 can include through-opening 717 configured to permit a wire, rope, circular metal, or other suitable fastener to be inserted through through-opening 717. Through-opening 717 can correspond to another through-opening 717 in another identical clipping member 601. When clipping members 601 are interlocked or otherwise engaged, through-openings 717 may be used for the purpose of further securing clipping members 601 to each other by metal wires being pushed through the through-opening 717 and attached on each side of through-opening 717. Through-opening 717 in conjunction with suitable fasteners can engage flexible support 103 thereby stabilizing system and/or permitting rotation around flexible support 103.

Clipping member 601 can be magnetically attractive by inclusion of one or more magnets. Magnetic clipping member 601 may include recesses configured to house the magnets. In another embodiment, magnetic clipping member 601 can omit interlocking feature 707 and engage another clipping member 601 almost primarily by the magnets. In one embodiment, the magnets 607 are arranged in an arrangement that attracts and positions the first mating portion 603 and second mating portion 605. For example, a set of magnets arranged in a north-south-north polarity configuration which corresponds to a set of magnets in south-north-south polarity configuration. In other embodiments, multiple sets of magnets 607 may be used.

Interlocking feature 707 may correspond with the interlocking receiving opening 705. Clipping member 601 may be interlocked with a corresponding clipping member 601 by inserting interlocking feature 707 into interlocking receiving opening 705 of the corresponding clipping member 601. Interlocking feature 707 of the corresponding clipping member 601 may be interlocked with the interlocking receiving opening 705 thereby permitting interlocking feature 707 to be visible through interlocking receiving opening 705.

Figure 9:
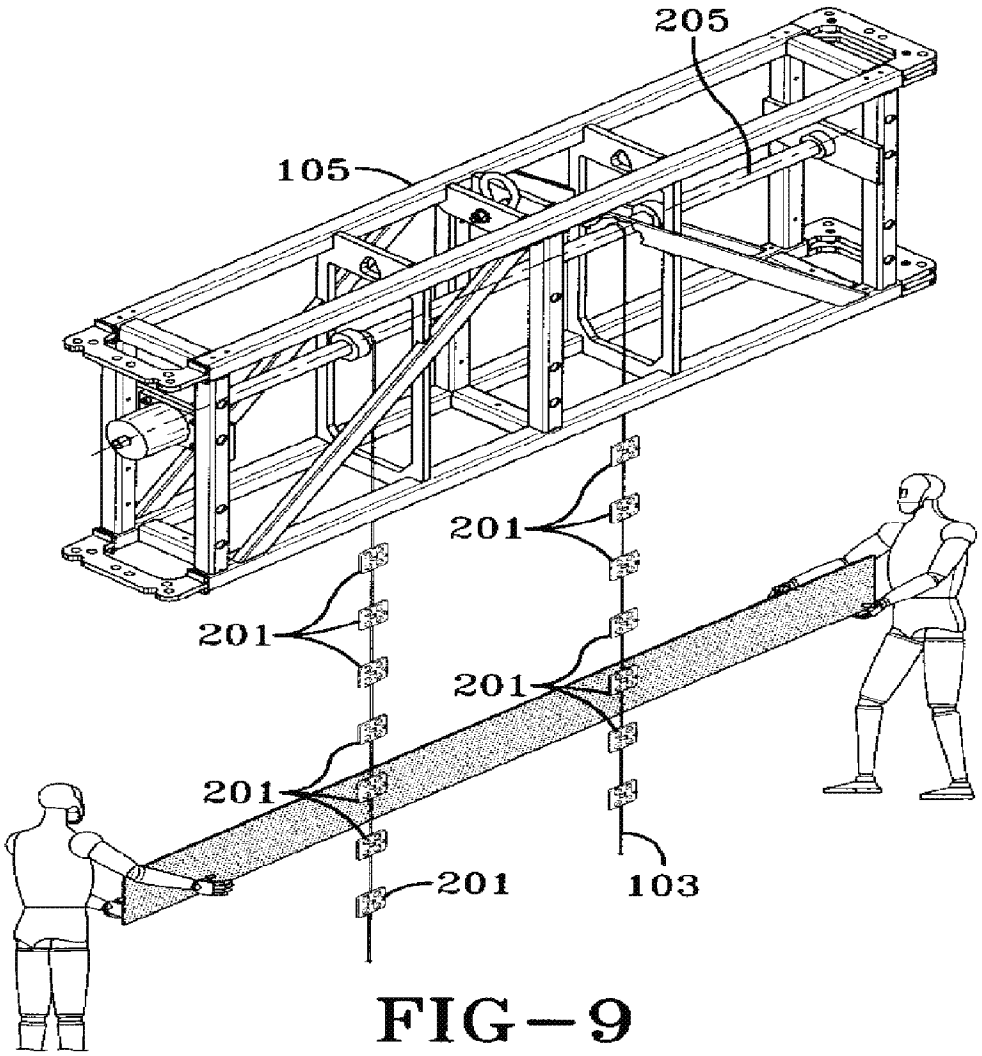
FIG. 9 illustrates a perspective view of another exemplary embodiment of a video display system.
Figure 10:
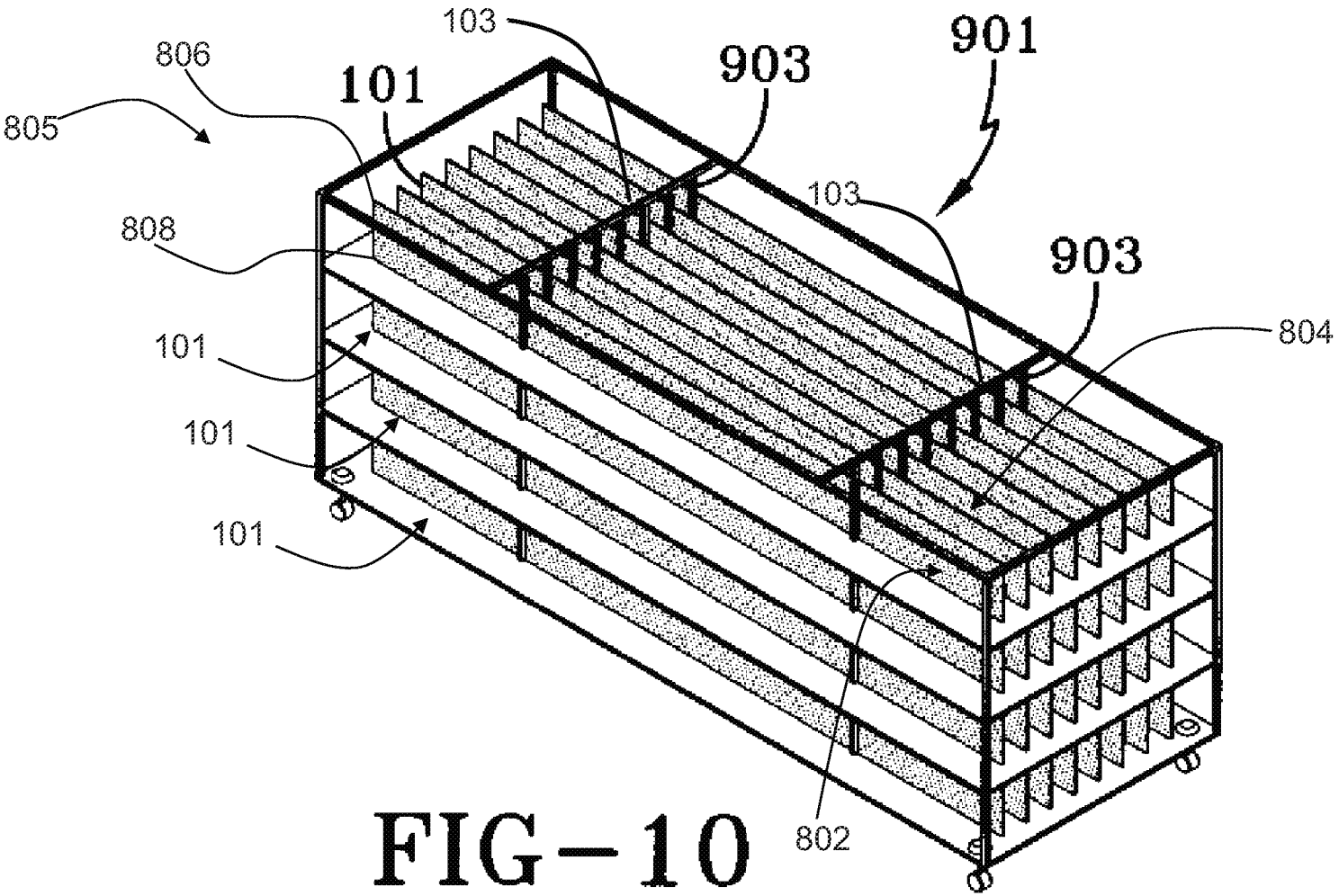
FIG. 10 illustrates a perspective view of an exemplary embodiment of a video display system including a cart of storage or transportation.
Figure 16:
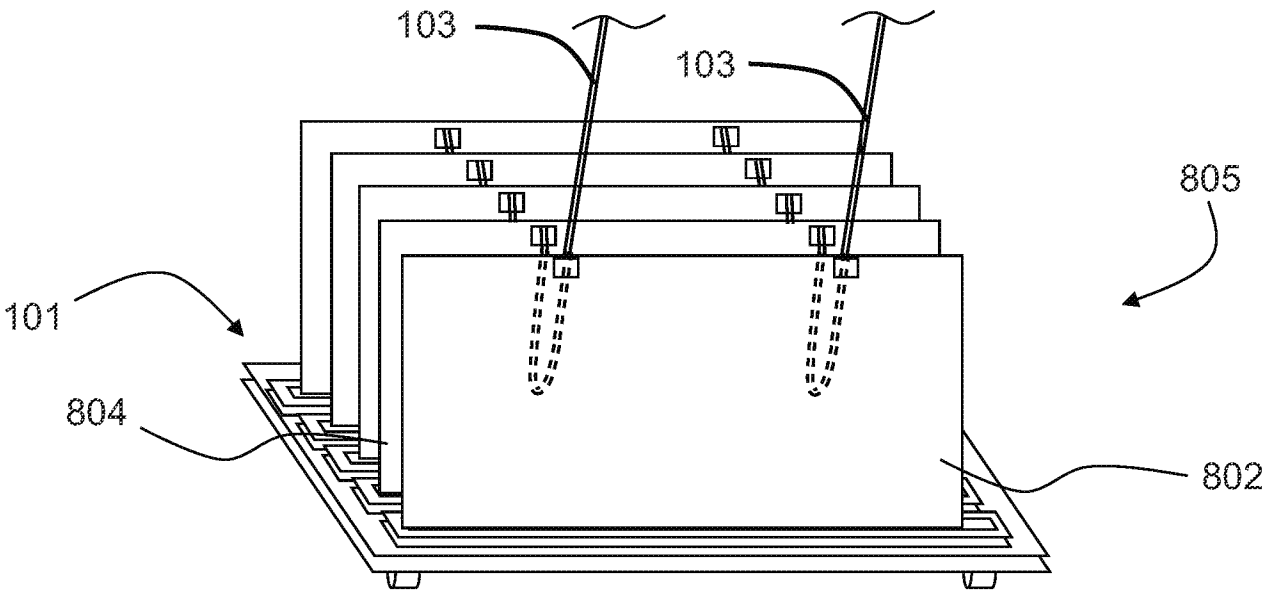
FIG. 16 illustrates an enlarged view of a display system according to an exemplary embodiment of the disclosure.

Referring to FIG. 10, a display storage unit 901, for example, a cart, can be configured for receiving and/or storing the system 100 (see FIG. 9). The display storage unit 901 is any suitable geometry capable of receiving and/or storing the system 100. For example, the display storage unit 901 can be a cuboid structure with or without walls and having a bottom sized for receiving display device 101. As shown in FIG. 10, in one embodiment, the display storage unit 901 includes a plurality of the display devices 101 arranged in layers, thereby permitting stepwise assembly or a large system 100. Alternatively, as shown in FIG. 16, in one embodiment, the display storage unit 901 includes one display device 101.

In one embodiment where display device 101 is a panel, the display storage unit 901 can be sized for the panel to be suspended from members 903 extending through at least a portion of the interior of display storage unit 901. In this embodiment, a plurality of display devices 101 may be inserted into the cart with each display device detachably engaging members 903 of display storage unit 901 by clipping member 601 and/or flexible support 103. Inserts (not shown) can be inserted between display devices 101 when display devices 101 are being stored in the display storage unit 901. In one embodiment, display storage unit 901 may include a plurality of levels or shelves permitting display devices 101 to be suspended in each of the levels. In one embodiment, the advancing by winding mechanism 205 may selectively permit display devices 101 to be inserted into display storage unit 901. In another embodiment, display devices 101 may be folded compactly into display storage unit 901 for more consolidated storage or transportation while flexible support 103 and/or the coupling device remain attached to display devices 101. In one embodiment, display device 101 may be lifted from the display storage unit 901 while manually or automatically disengaging members 903 of the display storage unit 901.

Figure 12:
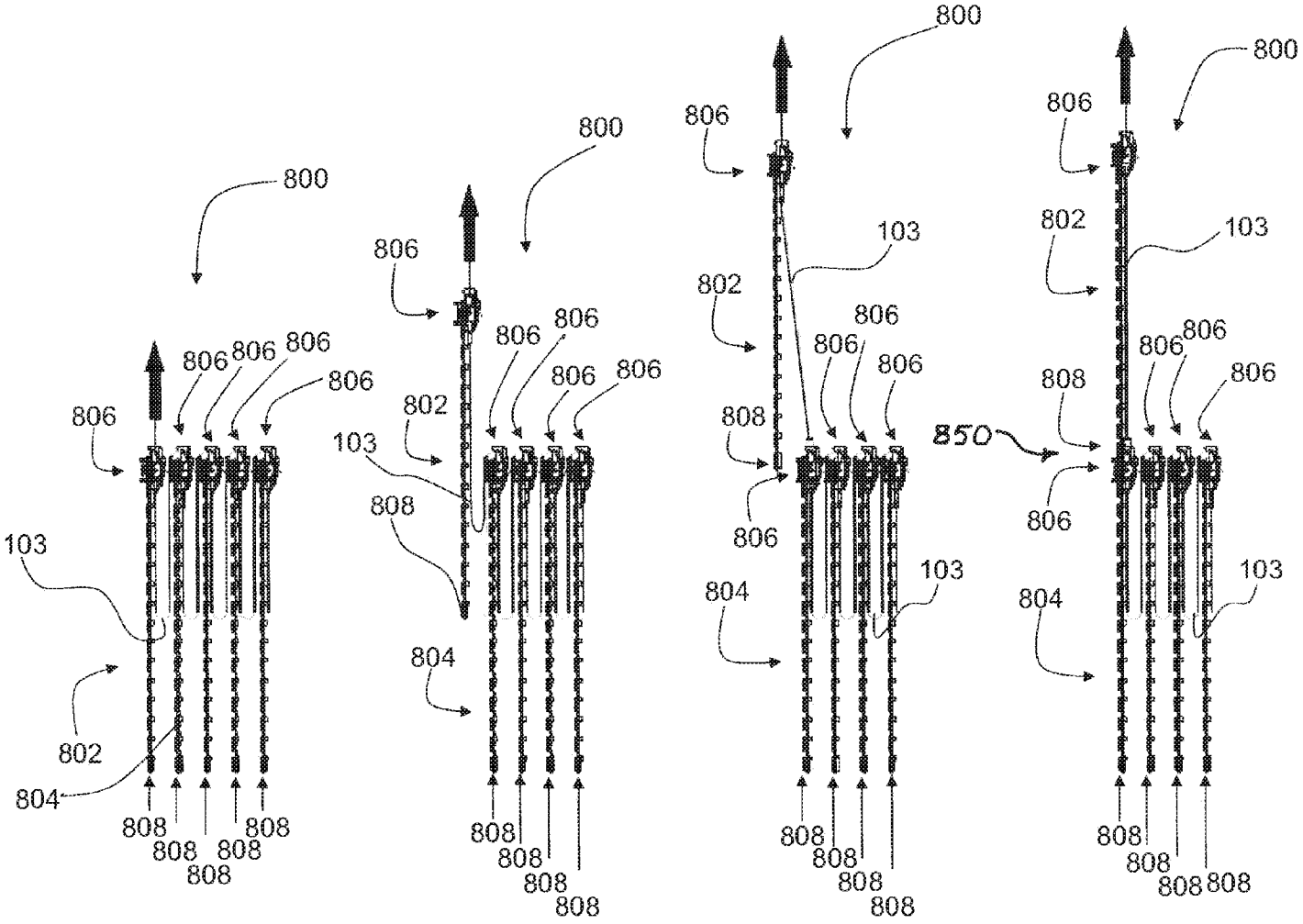
FIG. 12 illustrates a display system being erected according to an exemplary embodiment of the disclosure.

FIG. 12 shows a display system 800 being erected from a transport/storage mode to a display mode. The display system 800 includes a first display arrangement 802, a second display arrangement 804, and the flexible support 103 extending from the first display arrangement 802 to the second display arrangement 804. In one embodiment, the flexible support 103 includes a connecting feature, such as achieved by a flexible support interface 919 (FIG. 17) to connect the second display arrangement 804 to the first display arrangement 802, as discussed in further detail below. The first display arrangement 802 and/or the second display arrangement 804 are any suitable display arrangements. Suitable display arrangements include, but are not limited to, video panels, lattices (for example, LED lattices), mirrors, temporary wall panels, temporary wall surfaces, faux surfaces, temporary borders, electronic media, lights, panels of lights, paintings, printings, and combinations thereof.

The first display arrangement 802 and the second display arrangement 804 are capable of being positioned in the storage or transport mode as in FIG. 10, for example, within a transport container 805, such as the display storage unit 901, a case, a box, a cargo container, any other suitable vessel, or combinations thereof. In the embodiment shown in FIG. 12, the first display arrangement 802 and the second display selectively collapse into the transport container 805 (see FIG. 16) during storage or transport mode. In this embodiment, when erected (for example, as is generally shown in FIG. 11), an upper portion 806 of the second display arrangement 804 is positioned proximal to the lower portion 808 of the first display arrangement 802. Once proximally positioned, as further shown in FIG. 11, upper portion 806 of second display arrangement 804 and lower portion 808 of first display arrangement 802 include a mating connecting feature 850 (FIG. 12) for selectively engaging each other. However, when stored, the upper portion 806 of the first display arrangement 802 is positioned proximal to the upper portion 806 of the second display arrangement 804 and/or the lower portion 808 of the second display arrangement 804 is positioned proximal to the lower portion 808 of the first display arrangement 802. As will be appreciated, a third, fourth, fifth, and any other additional suitable number of display arrangements are likewise erected and/or stored.

In one embodiment, in order to store the first display arrangement 802 and the second display arrangement 804, such as in the transport container 805 as shown in FIG. 16, the mating connecting feature 850 (FIG. 12) between the first display arrangement 802 and the second display arrangement 804 is first disengaged. However, as further shown in FIG. 16, the connecting feature of the flexible support 103, such as achieved by a flexible support interface 919 (FIG. 17) to connect the second display arrangement 804 to the first display arrangement 802, is maintained.

In another embodiment, the order of display arrangements of display devices 101 can be reversed, or a mirror image of FIG. 11. For example, instead of erecting display device 101 as a result of first cables 103 extending from the first display arrangement 802 positioned in front of transport container 805 is shown in FIG. 16, display device 101 is erected as a result of first lifting cables 103 extending from the display arrangement positioned in the rear of transport container 805. As a result, when erected, the upper portion 806 of the first display arrangement 802 is positioned proximal to the lower portion 808 of the second display arrangement 804. However, when stored, the first display arrangement 802 and the second display arrangement sequentially collapse in storage or transport mode. For example, in this embodiment, when stored, the upper portion 806 of the first display arrangement 802 is positioned proximal to the lower portion 808 of the second display arrangement 804 and/or the upper portion 806 of the second display arrangement 804 is positioned proximal to the lower portion 808 of the first display arrangement 802. As will be appreciated, a third, fourth, fifth, and any other additional suitable number of display arrangements are likewise erected and/or stored.

Figure 13:
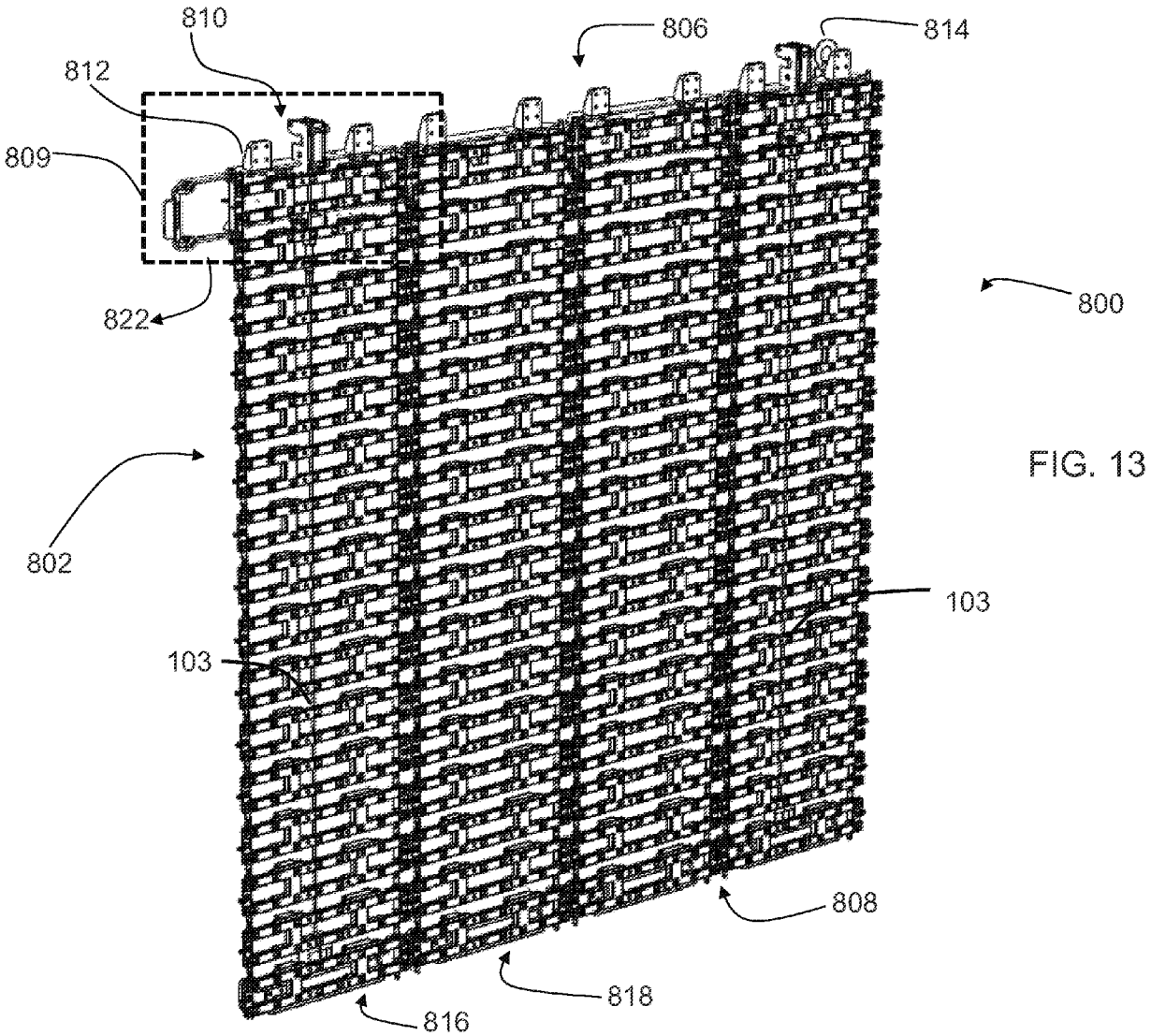
FIG. 13 illustrates a display system according to an exemplary embodiment of the disclosure.
Figure 14:
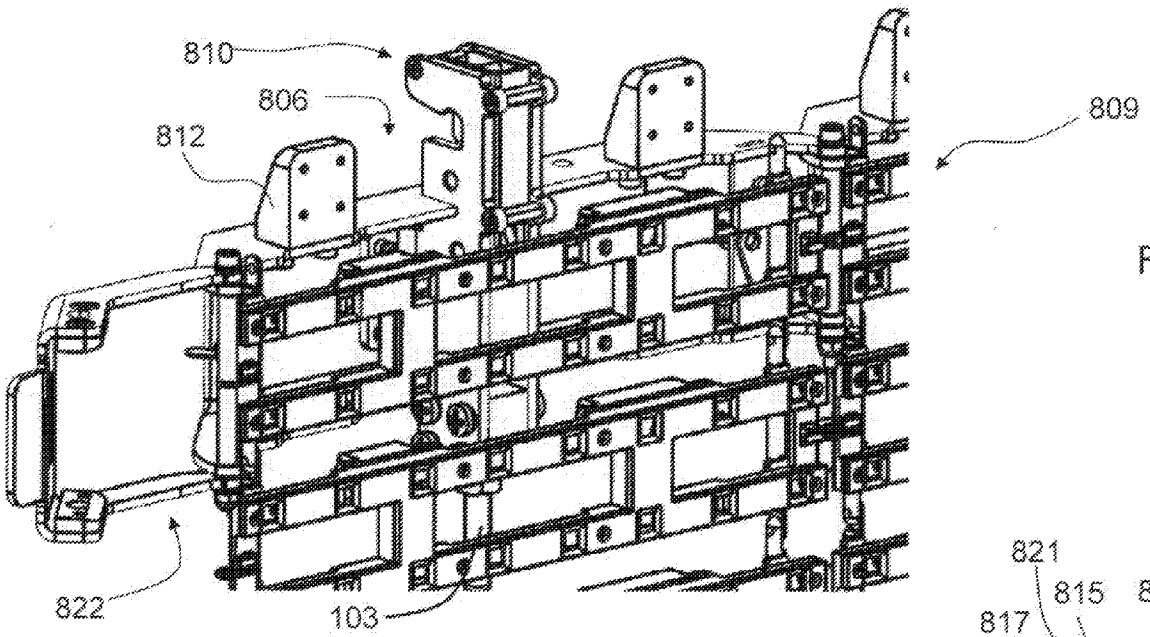
FIG. 14 illustrates an enlarged region of the display system of FIG. 13.
Figure 17:
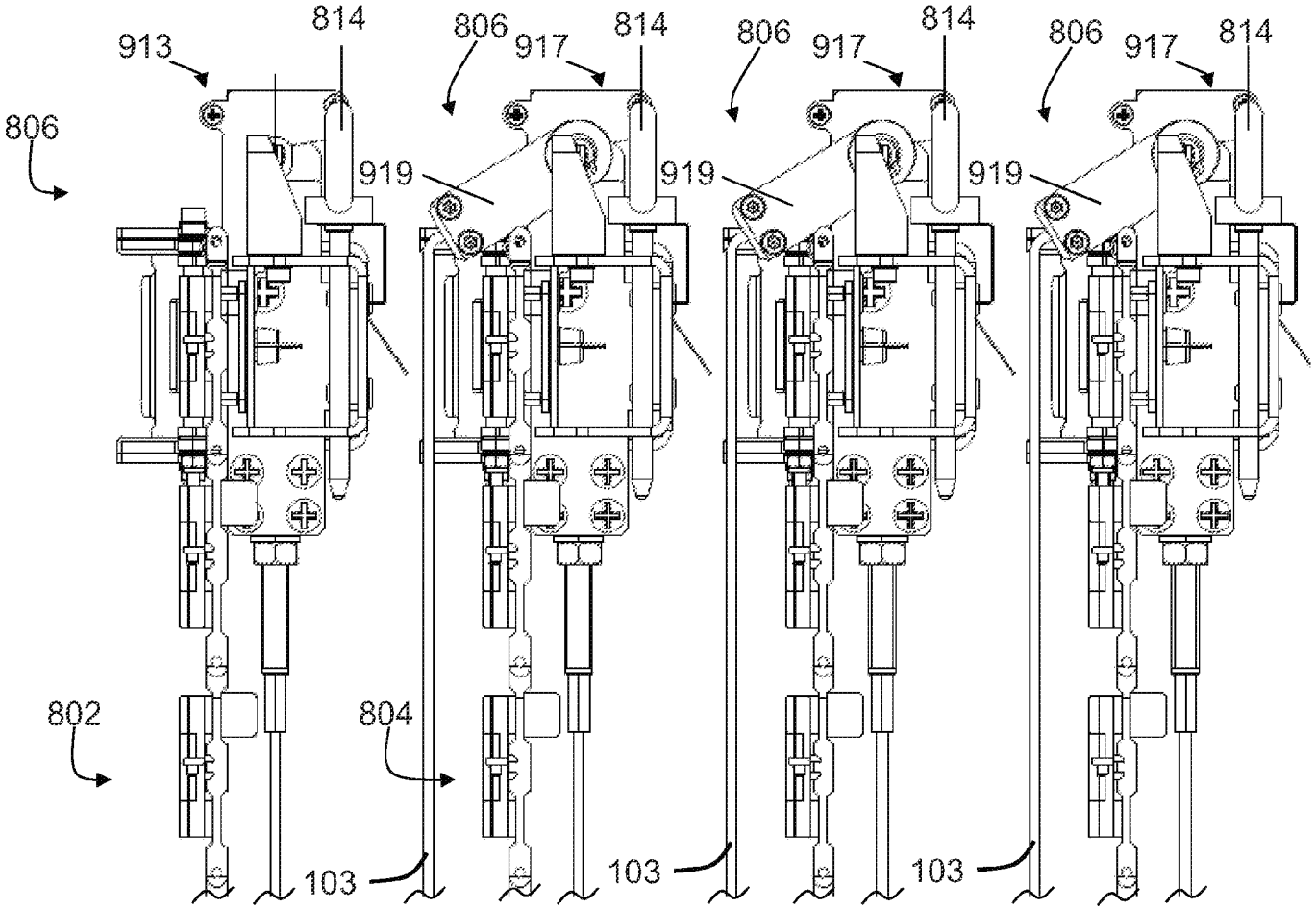
FIG. 17 illustrates an enlarged view of a display system according to an exemplary embodiment of the disclosure.

FIGS. 14 and 17 show an enlarged view of the upper portion 806 of the display system 800 shown in FIG. 13. The upper portion 806 of the first display arrangement 802 shows a member 913 extending from the first display arrangement 802 and the flexible support 103 positioned below the first display arrangement 802. The member 913 includes a release mechanism 814 that may be engaged to prevent unintended disengagement of the member 913 and any corresponding mechanism or device (not shown) that the display system 800 is suspended from. In one embodiment, the release mechanism 814 is capable of being manually engaged and disengaged. In another embodiment, the release mechanism 814 is capable of being engaged and disengaged by a tool. As shown in FIG. 12, the flexible support 103 flaccidly extends from the first display arrangement 802 to the second display arrangement 804.

Referring again to FIGS. 16 and 17, the second display arrangement 804 shows a second member 917 extending from the second display arrangement 804. The flexible support 103 extending from the first display arrangement 802 is secured to the second member 917 at a flexible support interface 919. The flexible support interface 919 is rotatably attached to the second member 917, thereby permitting movement of the flexible support 103 extending from the first display arrangement 802 to rotate upon the tension of the flexible support 103 being decreased, for example, by raising the first display arrangement 802. The flexible support 103 further extends from the second display arrangement 804 and to additional members 917 permitting sequential raising of the display arrangements.

Referring to FIG. 13, the display system 800 is a single package and self-aligning system. In one embodiment, the display system 800 is erected and/or stored by winding, for example, by using the winding mechanism 205 shown in FIG. 11 or a manual crank, a chain drive, or any other suitable drive mechanism for extending and retracting the flexible support 103. In one embodiment, winding of the winding mechanism 205 permits the system 800 to be erected automatically (for example, without use of human assembly) and/or at a substantially constant and uninterrupted speed. In another embodiment, winding of the winding mechanism 205 permits the system 800 to be erected in conjunction with an engagement feature 810 being manually engaged and/or in a step-wise process. The system 800 is either pre-wired providing power and/or control to the first display arrangement 802, the second display arrangement 804 (See FIG. 12), and/or other display arrangements or includes features for securing wiring upon being erected. In one embodiment, the system 800 is pre-wired such that erecting the system 800 permits controlled display according to embodiments of the disclosure.

In one embodiment, the display system 800 includes the engagement feature 810, a self-aligning feature 812, a display connector 822, a release mechanism 814, and/or any other suitable connecting features. As shown in enlarged region 809 of FIG. 14, in one embodiment, the self-aligning feature 812 is a substantially planar protrusion extending from the upper portion 806 of the first display arrangement 802 and/or the second display arrangement 804. The self-aligning feature 812 engages a corresponding self-aligning feature (not shown), thereby permitting the first display arrangement 802, the second display arrangement 804, and/or any other suitable number of display arrangements to be assembled in only one position. In one embodiment, the self-aligning feature 812 includes a magnetic panel. In a further embodiment, the self-aligning feature 812 includes a series of magnets arranged in a north-south-north arrangement and a parallel-oriented south-north-south arrangement corresponding to a south-north-south and a parallel-oriented north-south-north arrangement of the corresponding self-aligning feature.

Referring again to FIG. 13, the display connector 822 is configured to secure a first display arrangement set 816 to a second display arrangement set 818 and/or any additional suitable number of display arrangement sets (for example, a third, fourth, fifth, or sixth display arrangement set). The first display arrangement set 816 is secured to the second display arrangement set 818 by any suitable mechanism. In one embodiment, a pin is manually inserted into the display connector 822 upon the first display arrangement set 816 being positioned proximal to the second display arrangement set 818. In one embodiment, the display connector 822 restricts relative movement of the first display arrangement set 816 and the second display arrangement set 818 such that the first display arrangement set 816 and the second display arrangement set 818 form a predetermined shape for the display system 800 (for example, a substantially planar shape, an angled shape, or any other suitable shape). In another embodiment, the display connector 822 permits relative movement of the first display arrangement set 816 and the second display arrangement set 818 such that the first display arrangement set 816 and the second display arrangement set 818 can be used for three-dimensional effects (for example, opening like a book, opening like a flower, or any other suitable effect).

The release mechanism 814 is any suitable mechanism for disengaging the first display arrangement 802 from the second display arrangement 804 and/or additional display arrangements. Referring to FIGS. 13 and 17, in one embodiment, the release mechanism 814 is a loop capable of being accessed with a pole or other suitable member. In this embodiment, the loop can be pulled when the system 800 is in display mode, thereby permitting the first display arrangement 802 to be disengaged from the second display arrangement 804 and repositioned into the storage/transport mode. For example, in one embodiment, the release mechanism 814 is operably connected to the flexible support 103. By adjusting the release mechanism 814, the amount of tension in the flexible support 103 is increased or decreased, thereby permitting the disengagement between the first display arrangement 802 and the second display arrangement 804.

Figure 15:
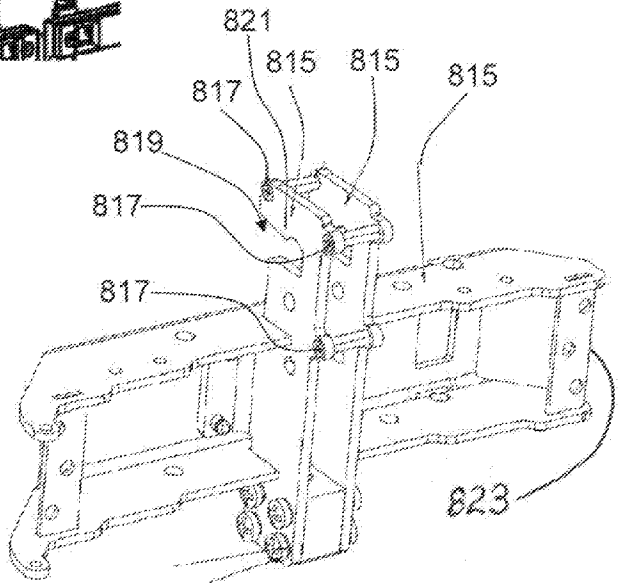
FIG. 15 illustrates an engagement feature according to an exemplary embodiment of the disclosure.

FIG. 15 shows an embodiment of the engagement feature 810 (FIG. 13). The engagement feature 810 includes substantially parallel planar portions 815 secured by one or more pins 817 or other suitable fastening mechanisms forming a recess 819 or other suitable engagement region. The parallel planar portions 815 and the one or more pins 817 secure the first display arrangement 802 to the second display arrangement and/or additional display arrangements. In one embodiment, the recess 819 includes a protrusion portion 821 permitting a detent effect upon engagement of the first display arrangement 802 with the second display arrangement 804. Additionally, in one embodiment, the engagement feature 810 includes a bracket 823 (FIG. 15) for securing the display device 101 (see FIG. 11).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A display system, comprising:

a first electrical display arrangement;

a second electrical display arrangement being electrically connectable to the first electrical display arrangement;

the first electrical display arrangement and the second electrical display arrangement being movable between a stored position and a deployed position; and a flexible support segment extending from the first electrical display arrangement to the second electrical display arrangement, the flexible support segment having a first connecting feature configured to connect the second electrical display arrangement to the first electrical display arrangement;

the first electrical display arrangement and the second electrical display arrangement having a second connecting feature selectively engaging the first electrical display arrangement and the second electrical display arrangement in the deployed position;

wherein when the first electrical display arrangement and the second electrical display arrangement are in the deployed position, the first connecting feature is connected to the first electrical display arrangement and the second electrical display arrangement, and the second connecting feature engages the first electrical display arrangement and the second electrical display arrangement;

wherein when the first electrical display arrangement and the second electrical display arrangement are in the stored position, the first connecting feature is connected to the first electrical display arrangement and the second electrical display arrangement, and the second connecting feature disengages and permits storage of the first electrical display arrangement and the second electrical display arrangement;

said engagement feature comprising a positioning feature capable of adjusting the relative position of the first electrical display arrangement in comparison to the second electrical display arrangement;

a flexible support extending from the first electrical display arrangement to the second electrical display arrangement;

wherein the first electrical display arrangement engages the second electrical display arrangement by movement of the flexible support;

wherein the first electrical display arrangement and the second electrical display arrangement, when assembled, form two parts of a continuous display.

2. The system of claim 1, wherein the first electrical display arrangement includes displays selected from the group consisting of video panels, LED lattices, electronic media, lights, panels of lights, and combinations thereof.

3. The system of claim 1, wherein the first electrical display arrangement and the second electrical display arrangement collapse into a transport container with an upper portion of the first electrical display arrangement being positioned proximal to an upper portion of the second electrical display arrangement.

4. The system of claim 1, wherein the first electrical display arrangement and the second electrical display arrangement sequentially collapse into a transport container with an upper portion of the first electrical display arrangement being positioned proximal to a lower portion of the second electrical display arrangement.

5. The system of claim 1, further comprising a winding mechanism operably connected to the flexible support segment, wherein movement of the winding mechanism moves the flexible support.

6. The system of claim 5, wherein the winding mechanism includes a manual crank.

7. The system of claim 5, wherein the winding mechanism includes a chain drive.

8. The system of claim 1, wherein the system is configured to be erected automatically by movement of the flexible support.

9. The system of claim 1, wherein the system is configured to be erected at a substantially constant and uninterrupted speed.

10. The system of claim 1, wherein the system is configured to be erected in conjunction with an the second connecting feature being manually engaged.

11. The system of claim 1, further comprising a display connector configured to secure a first electrical display arrangement set to a second electrical display arrangement set, the first electrical display arrangement set including the first electrical display arrangement and the second electrical display arrangement.

12. The system of claim 11, wherein relative movement between the first electrical display arrangement and the second electrical display arrangement is restricted to form a predetermined shape.

13. A display process, comprising:

providing a video display system having a first electrical display arrangement having a self-aligning feature, second electrical display arrangement being electrically connectable to the first electrical display arrangement, an engagement feature configured to selectively engage the first electrical display arrangement to the second electrical display arrangement and a flexible support extending from the first electrical display arrangement to the second electrical display arrangement;

arranging a video display system having a first display arrangement and a second display arrangement, the first electrical display arrangement and the second electrical display arrangement being movable between a stored position and a deployed position, a flexible support segment extending from the first electrical display arrangement to the second electrical display arrangement, the flexible support segment having a first connecting feature configured to connect the second electrical display arrangement to the first electrical display arrangement, the first electrical display arrangement and the second electrical display arrangement having a second connecting feature selectively engaging the first electrical display arrangement and the second electrical display arrangement in the deployed position, wherein when the first electrical display arrangement and the second electrical display arrangement are in the deployed position, the first connecting feature is connected to the first electrical display arrangement, and the second electrical display arrangement, and the second connecting feature engages the first electrical display arrangement and the second electrical display arrangement, wherein when the first electrical display arrangement and the second electrical display arrangement are in the stored position, the first connecting feature is connected to the first electrical display arrangement and the second electrical display arrangement, and the second connecting feature disengages and permits storage of the first electrical display arrangement and the second electrical display arrangement;

moving the first electrical display arrangement and the second electrical display arrangement from the stored position to the deployed position, forming two parts of a continuous display.

* * * * *